US010301766B2

(12) United States Patent
Jung et al.

(10) Patent No.: US 10,301,766 B2
(45) Date of Patent: May 28, 2019

(54) LAUNDRY TREATMENT APPARATUS

(71) Applicant: LG ELECTRONICS INC., Seoul (KR)

(72) Inventors: Jinhwan Jung, Seoul (KR); Byunghyun Yi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/310,408

(22) PCT Filed: Jul. 2, 2015

(86) PCT No.: PCT/KR2015/006823
§ 371 (c)(1),
(2) Date: Nov. 10, 2016

(87) PCT Pub. No.: WO2016/003217
PCT Pub. Date: Jan. 7, 2016

(65) Prior Publication Data

US 2017/0145623 A1 May 25, 2017

(30) Foreign Application Priority Data

Jul. 3, 2014 (KR) ..... 10-2014-0082951

(51) Int. Cl.
*D06F 73/00* (2006.01)
*D06F 58/20* (2006.01)
(Continued)

(52) U.S. Cl.
CPC ..... *D06F 73/00* (2013.01); *D06F 58/203* (2013.01); *D06F 59/02* (2013.01); *D06F 58/10* (2013.01)

(58) Field of Classification Search
CPC ..... D06F 58/203; D06F 73/00; D06F 73/02; A47G 25/28; A47G 25/60
(Continued)

(56) References Cited

U.S. PATENT DOCUMENTS 5,687,278 A * 11/1997 Turner ..... D06F 73/00 219/211
2005/0120757 A1* 6/2005 Jackson ..... D06F 73/02 68/5 C
2011/0203130 A1* 8/2011 Date ..... D06F 58/203 34/565

FOREIGN PATENT DOCUMENTS

CN 201571873 U * 9/2010
CN 203252394 10/2013
(Continued)

OTHER PUBLICATIONS

Machine translation of JP H10298 A, dated Jan. 1998.*
(Continued)

*Primary Examiner* — Joseph L. Perrin
*Assistant Examiner* — Kevin G Lee
(74) *Attorney, Agent, or Firm* — Fish & Richardson P.C.

(57) ABSTRACT

Disclosed is a laundry treatment apparatus and, more particularly, to a laundry treatment apparatus which is reduced in size to enhance portability. The laundry treatment apparatus includes a body configured to be separably coupled to a support structure provided at the outside of the laundry treatment apparatus, the body serving to support clothes, a suction portion provided in the body to inhale outside air to the inside of the body, a fan configured to introduce the outside air to the inside of the body through the suction portion, a heater configured to heat the air introduced through the suction portion, and an exhaust portion provided in the body to discharge the air passed through the heater to the outside of the body.

15 Claims, 7 Drawing Sheets

(51) Int. Cl.
*D06F 59/02* (2006.01)
*D06F 58/10* (2006.01)

(58) Field of Classification Search
USPC ..... 68/222
See application file for complete search history.

(56) References Cited

FOREIGN PATENT DOCUMENTS

| | | | | | |
|---|---|---|---|---|---|
| DE | 20218564 | U1 * | 4/2003 | ..... | D06F 59/02 |
| JP | H10298 | A * | 1/1998 | | |
| KR | 10-2010-0106709 | | 10/2010 | | |
| KR | 10-2011-0000612 | | 1/2011 | | |
| KR | 10-2011-0137703 | | 12/2011 | | |
| WO | 2008/111982 | | 9/2008 | | |
| WO | WO-2008111982 | A1 * | 9/2008 | ..... | D06F 59/02 |

OTHER PUBLICATIONS

Machine translation of DE 20218564 U1, dated Apr. 2003.*
Machine translation of CN 201571873 U, dated Sep. 2010. (Year: 2010).*
International Search Report and Written Opinion in International Application No. PCT/KR2015/006823, dated Aug. 25, 2015, 11 pages.
Extended European Search Report in European Application No. 15815818.8, dated Jan. 29, 2018, 8 pages (with English translation).

* cited by examiner

[Fig. 1]
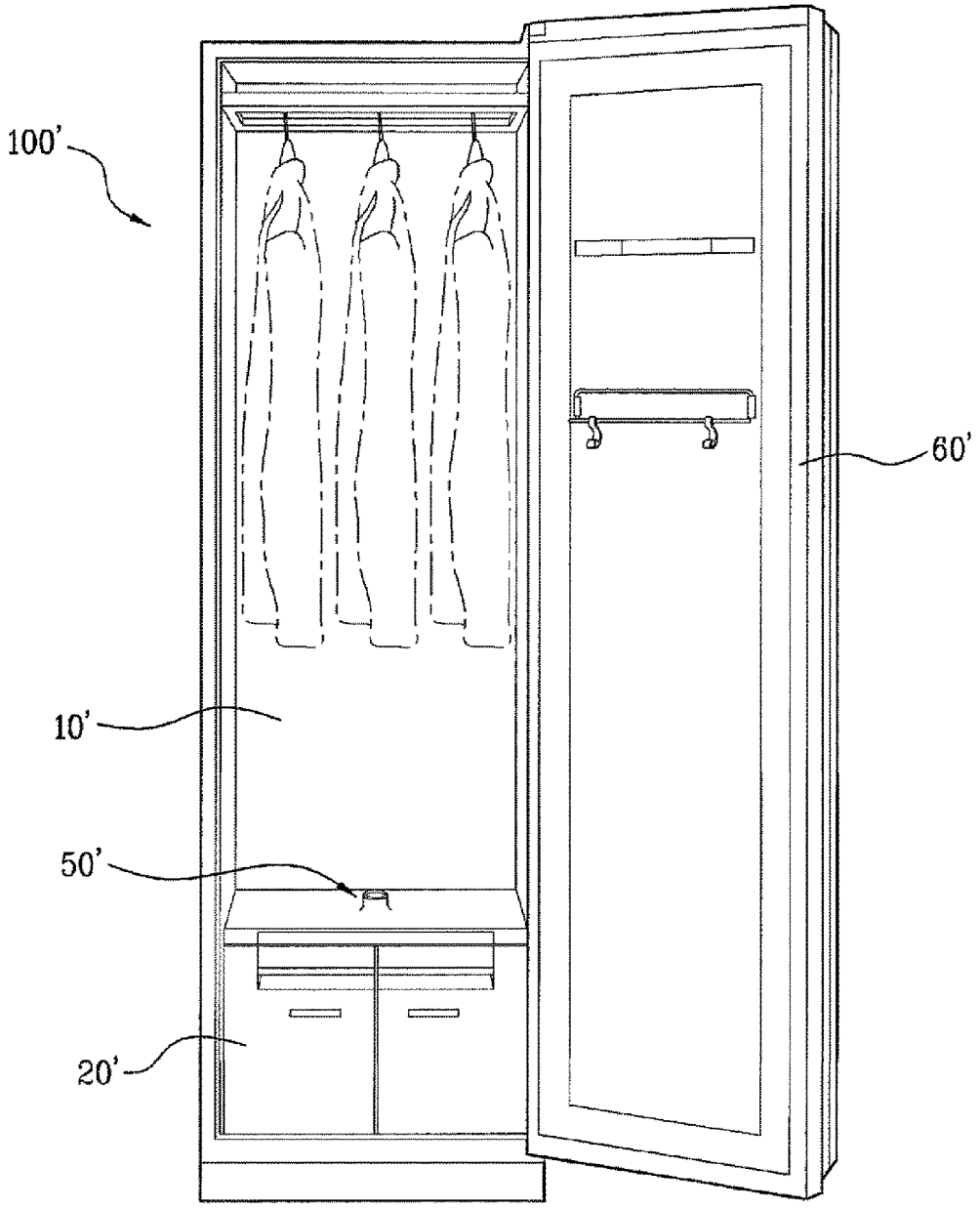

[Fig. 2]
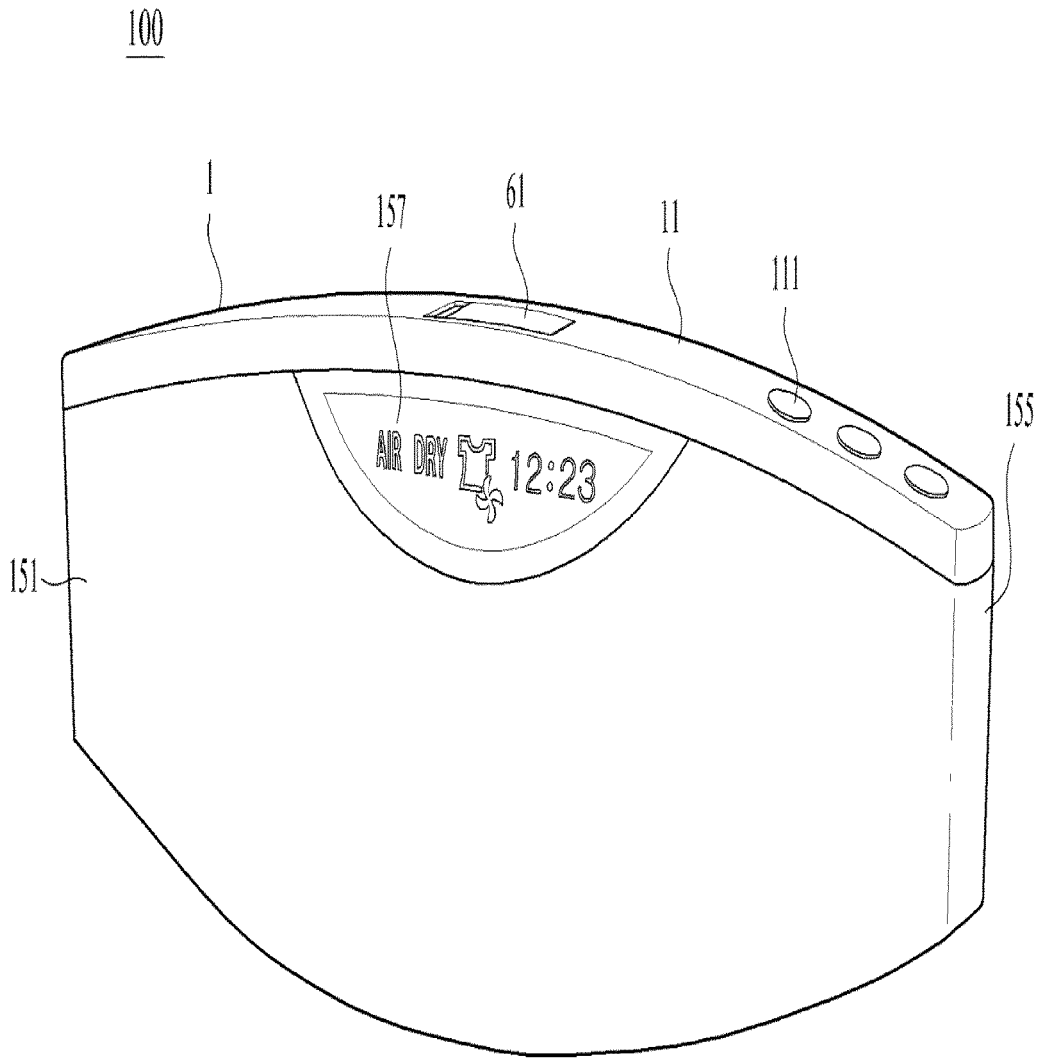

[Fig. 3]
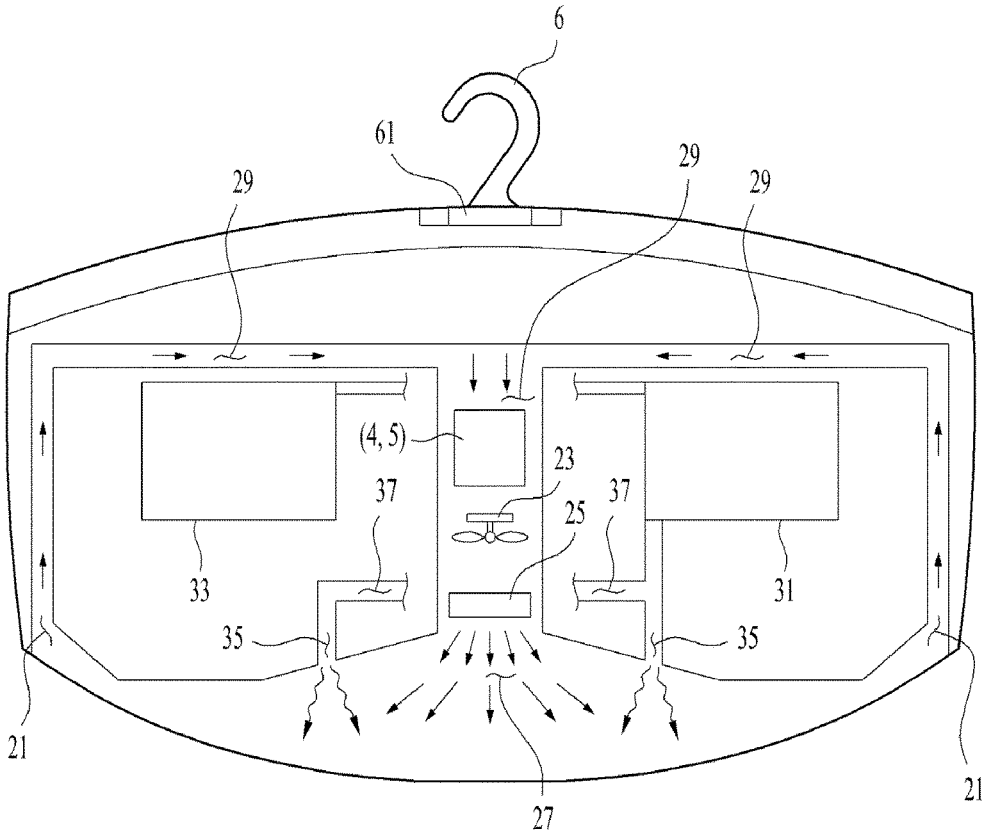

[Fig. 4]
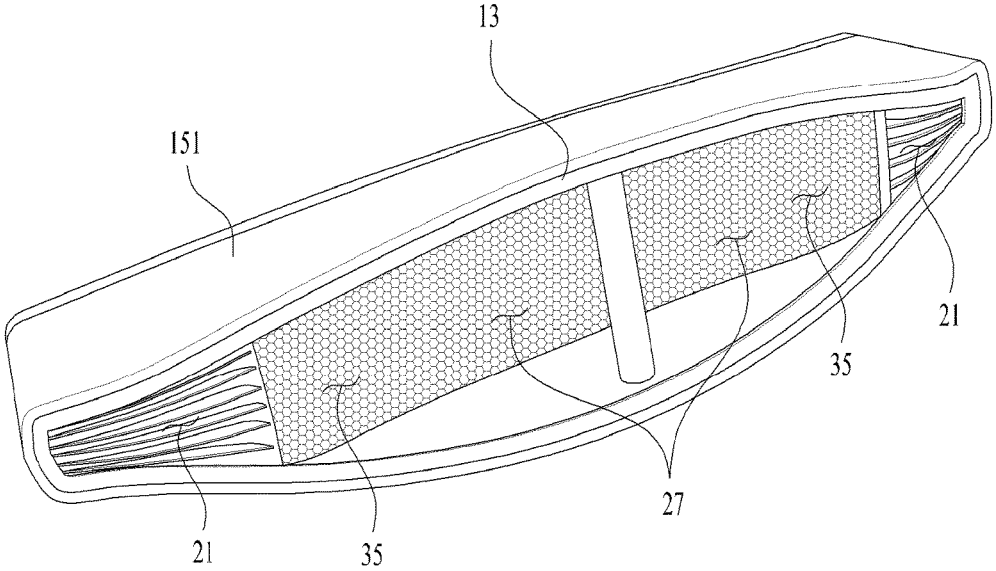

[Fig. 5]
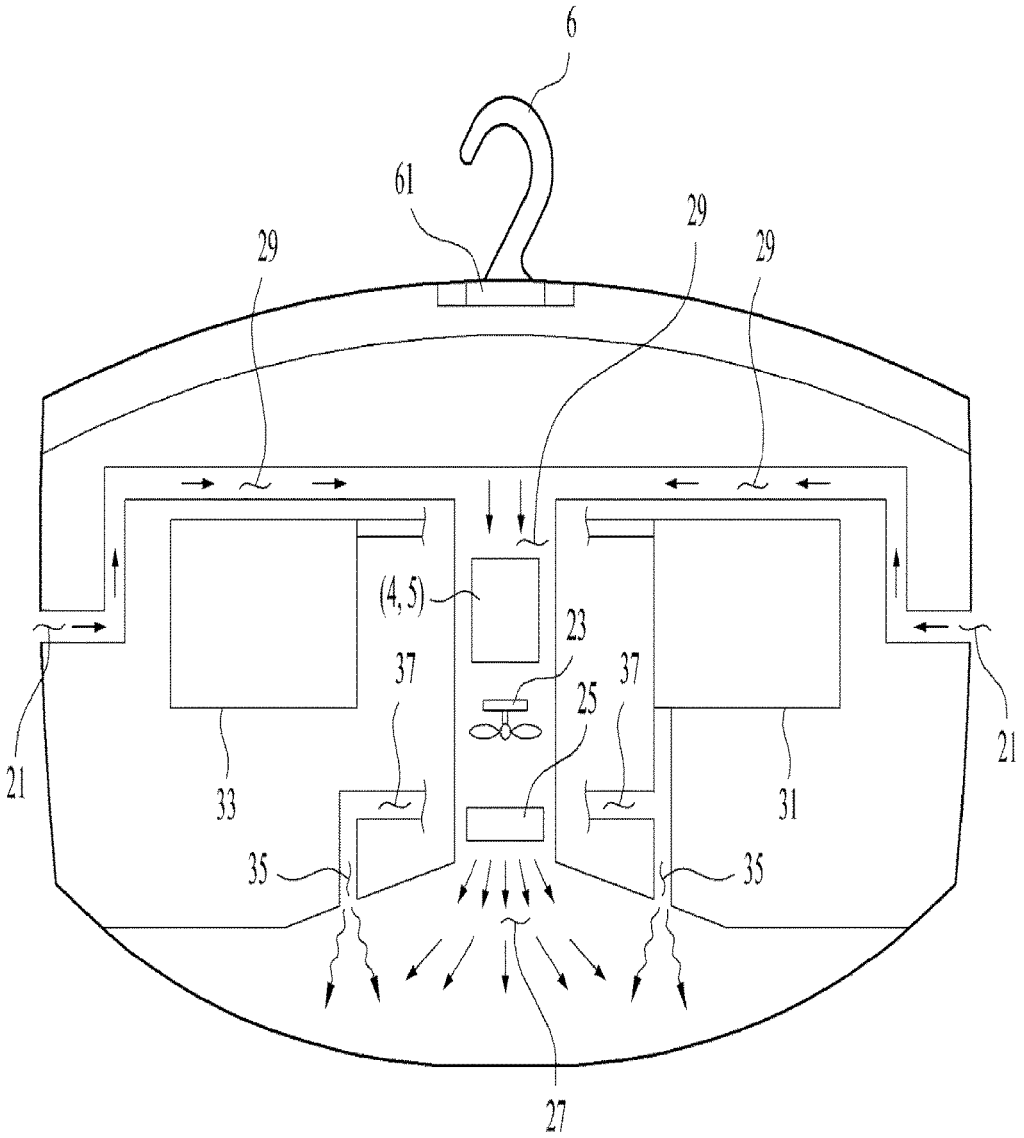

[Fig. 6]
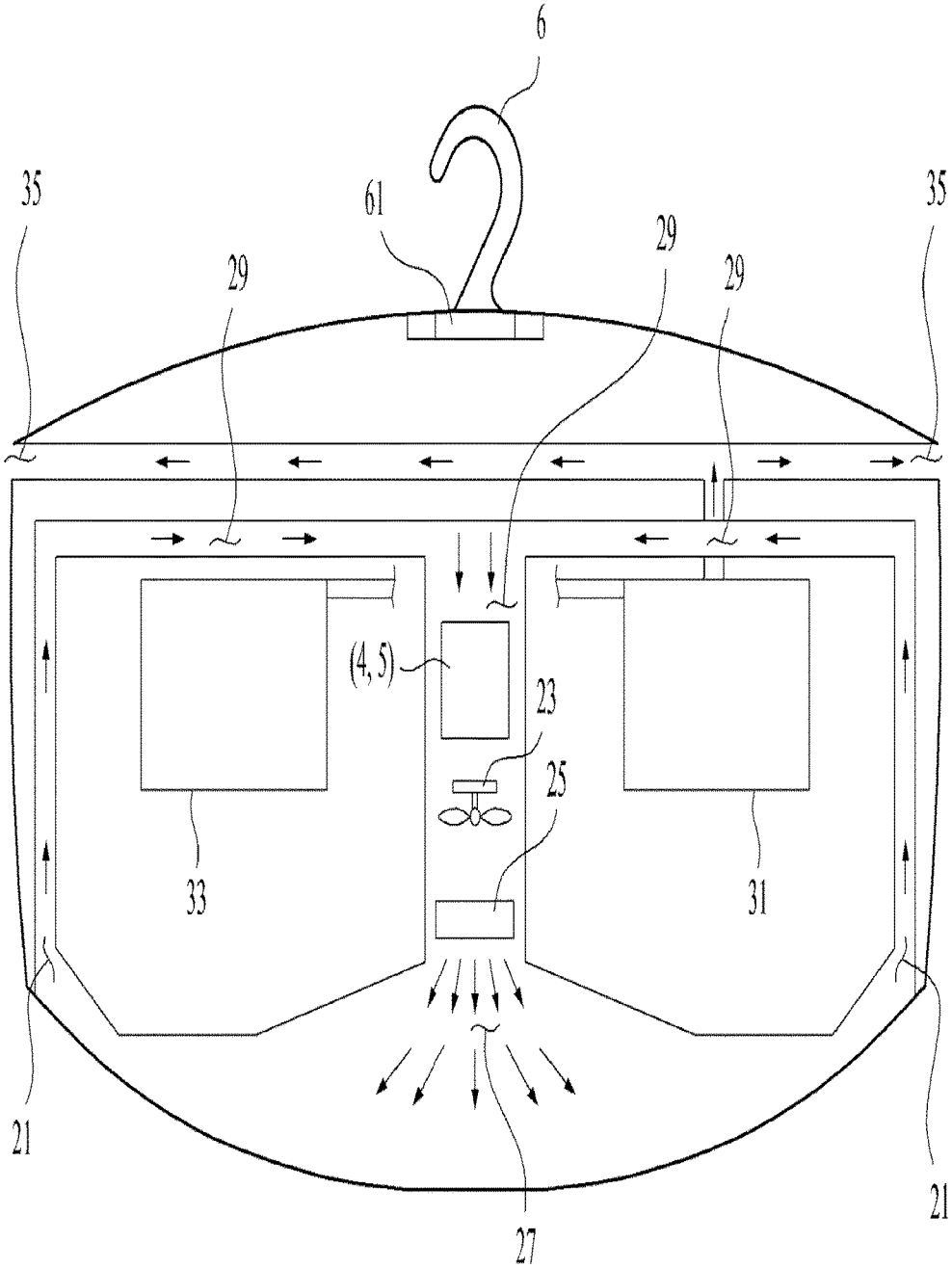

[Fig. 7]
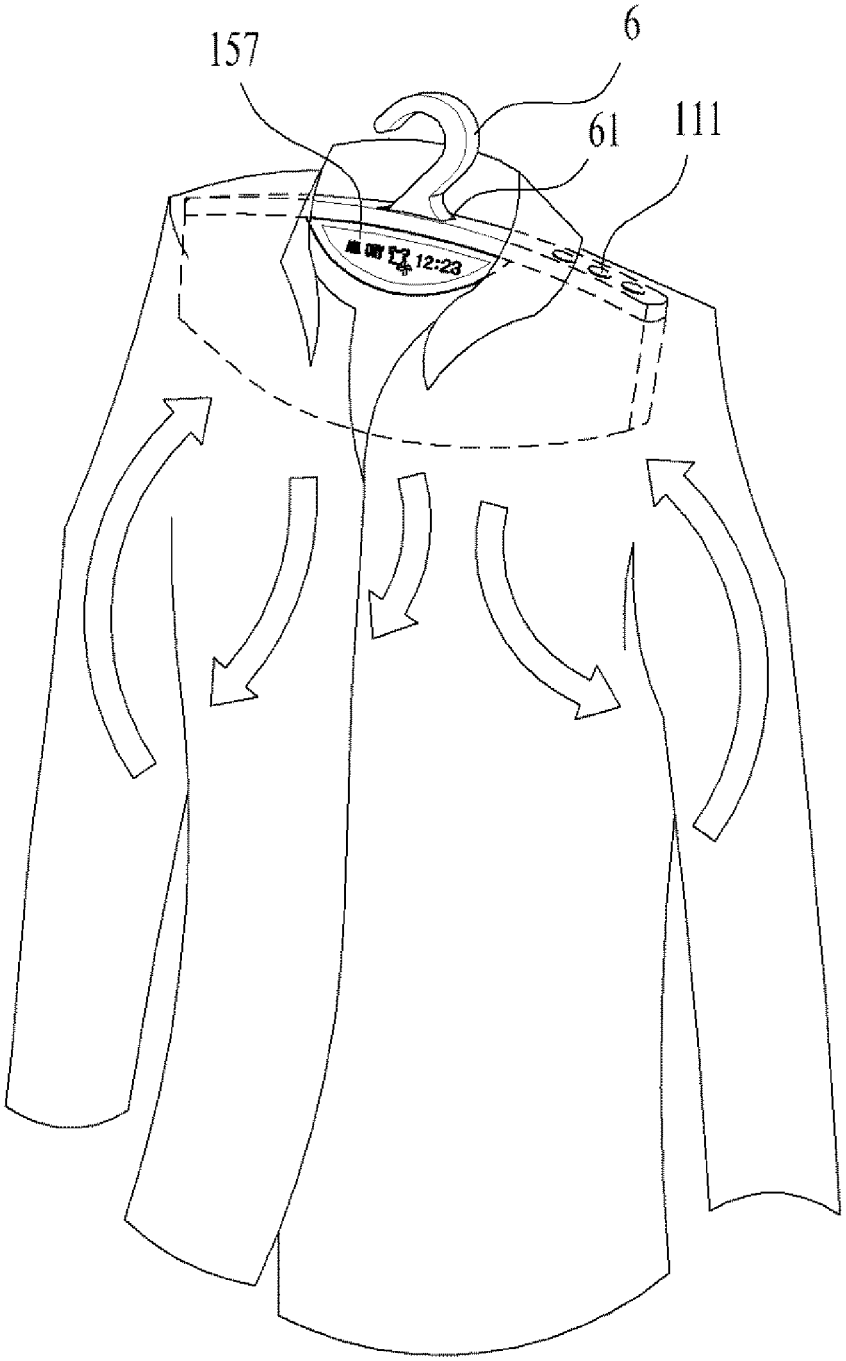

LAUNDRY TREATMENT APPARATUS

CROSS REFERENCE TO RELATED APPLICATIONS

This application is a U.S. National Phase Application under 35 U.S.C. § 371 of International Application PCT/KR2015/006823, filed on Jul. 2, 2015, which claims the benefit of Korean Application No. 10-2014-0082951, filed on Jul. 3, 2014, the entire contents of which are hereby incorporated by reference in their entireties.

TECHNICAL FIELD

The present invention relates to a laundry treatment apparatus and, more particularly, to a laundry treatment apparatus which is reduced in size to enhance portability.

BACKGROUND ART

A general laundry treatment apparatus refers to an apparatus that includes a cabinet defining the external appearance of the apparatus and a receiving compartment provided inside the cabinet and that serves to remove odors, wrinkles, moisture, or the like from clothes by supplying steam and hot air to the clothes received in the receiving compartment.

In the case of worn clothes, odors, wrinkles, or the like may remain in the clothes, which may be unpleasant for a user who wears the same clothes. To overcome this, the user has to wash the clothes, which reduces the lifespan of the clothes and increases the maintenance costs of the clothes. In addition, the user has to additionally perform, for example, ironing in order to remove wrinkles generated in the clothes. A laundry treatment apparatus may be used to solve these problems.

To remove odors, wrinkles, moisture, or the like from clothes received therein, the laundry treatment apparatus may eject steam to the clothes and use hot air to dry the clothes which contain moisture due to the ejected steam.

When steam is ejected to the clothes received in the laundry treatment apparatus, water particles as water vapor are bound with odor particles remaining in fibrous tissues and, in turn, the odor particles are removed from the clothes as the water particles bound with the odor particles evaporate in the process of drying the clothes by supplying hot air thereto.

In addition, when steam is ejected to the clothes received in the laundry treatment apparatus, wrinkles in the clothes are reduced or removed in the process of drying the clothes, wetted by the steam, using, for example, hot air.

As exemplarily illustrated in FIG. 1, a conventional laundry treatment apparatus 100' includes a cabinet defining the external appearance of the apparatus, and a receiving compartment 10', in which clothes are received, is defined in an upper region of the cabinet. The receiving compartment 10' is opened and closed by a door 60'. An electric machine room 20' is located in a lower region of the cabinet. The electric machine room 20' receives, for example, a steam supply device (not illustrated) to generate steam to be supplied to the receiving compartment 10' and a hot air supply device (not illustrated) to supply hot air to the receiving compartment 10'. The steam supply device (not illustrated) received in the electric machine room 20' is adapted to eject steam through a steam ejection unit 50' received in the receiving compartment 10'.

The conventional laundry treatment apparatus 100', however, has the following problems.

First, the conventional laundry treatment apparatus requires the receiving compartment in which clothes are received and, thus, is bulky.

Second, the conventional laundry treatment apparatus must be operated even when it is desired to refresh only a single shirt or pair of pants, which results in wasted power.

Third, the conventional laundry treatment apparatus has low portability and is limited in terms of the times and places that it can be used by users.

DISCLOSURE OF INVENTION

Technical Problem

Therefore, the present invention has been made in view of the above problems and it is an object of the present invention to provide a laundry treatment apparatus which enables even a single shirt or pair of pants to be effectively and efficiently refreshed owing to the reduced size thereof and which achieves enhanced portability to allow a user to use the laundry treatment apparatus at a desired time and place.

Solution to Problem

In accordance with one aspect of the present invention, the above and other objects can be accomplished by the provision of a laundry treatment apparatus including a body configured to be separably coupled to a support structure provided at the outside of the laundry treatment apparatus, the body serving to support clothes, a suction portion provided in the body inhale outside air to the inside of the body, a fan configured to introduce the outside air to the inside of the body through the suction portion, a heater configured to heat the air introduced through the suction portion, and an exhaust portion provided in the body to discharge the air passed through the heater to the outside of the body.

The laundry treatment apparatus may further include a steam supply device provided inside the body for supplying steam to the outside of the body.

The steam supply device may include a steam generator configured to generate the steam, a water supplier configured to supply water to the steam generator, and a steam outlet configured to discharge the steam, generated by the steam generator, to the outside of the body.

The laundry treatment apparatus may further include a deodorization filter provided inside the body for removing odors from the clothes.

The deodorization filter may be replaceable.

The laundry treatment apparatus may further include a fragrance supply unit provided inside the body for emitting fragrance to the outside of the body.

The fragrance supply unit may be replaceable.

The laundry treatment apparatus may further include an air circulation flow path provided inside the body to connect the suction portion and the exhaust portion to each other.

The laundry treatment apparatus may further include an air circulation flow path provided inside the body to connect the suction portion and the exhaust portion to each other, and a steam discharge flow path configured to connect the steam generator and the steam outlet to each other.

The steam discharge flow path may be connected to the air circulation flow path to supply the steam by using the air moving inside the air circulation flow path.

The laundry treatment apparatus may further include an air circulation flow path provided inside the body to connect the suction portion and the exhaust portion to each other, and the deodorization filter may be provided in the air circulation flow path.

The laundry treatment apparatus may further include an air circulation flow path provided inside the body to connect the suction portion and the exhaust portion to each other, and the fragrance supply unit may be provided in the air circulation flow path.

The steam outlet may be formed at one side of the exhaust portion.

The steam outlet may be formed at one side of the suction portion.

Any one of the suction portion and the exhaust portion may be perforated in a lower surface of the body and the other one may be provided at each of opposite ends of the perforated part.

Any one of the suction portion and the exhaust portion may be perforated in a lower surface of the body and the other one may be perforated in an outer circumferential surface of the body.

The laundry treatment apparatus may further include a hook configured to support the body at the support structure.

The laundry treatment apparatus may further include a hook separable coupling member provided at the upper surface of the body to separably couple the hook to the body.

Advantageous Effects of Invention

With the technical solution as described above, the present invention has the effect of providing a laundry treatment apparatus which enables even a single shirt or pair of pants to be effectively and efficiently refreshed owing to the reduced size thereof and which achieves enhanced portability to allow a user to use the laundry treatment apparatus at a desired time and place.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view illustrating one embodiment of a conventional laundry treatment apparatus;

FIG. 2 is a perspective view illustrating a laundry treatment apparatus according to a first embodiment of the present invention;

FIG. 3 is a sectional view of the laundry treatment apparatus according to the first embodiment of the present invention;

FIG. 4 is a bottom perspective view of the laundry treatment apparatus according to the first embodiment of the present invention in the case where a steam outlet is provided at one side of an exhaust portion;

FIG. 5 is a sectional view of a laundry treatment apparatus according to a second embodiment of the present invention;

FIG. 6 is a sectional view of a laundry treatment apparatus according to a third embodiment of the present invention; and FIG. 7 is a view illustrating the laundry treatment apparatus according to the present invention in a state of being in use.

BEST MODE FOR CARRYING OUT THE INVENTION

Hereinafter, exemplary embodiments of the present invention will be described in detail with reference to the accompanying drawings.

So long as being not specially defined, all terms in the context of describing the invention may be commonly understood by those skilled in the art to have the same meaning as the general meaning, or may be dedicatedly defined in the specification when having a specific meaning conflicting with the general meaning thereof.

Meanwhile, a configuration or a control method of an apparatus that will be described hereinafter is provided for explanation of the embodiments of the present invention, and is not intended to limit a technical range of the present invention. The same reference numerals of the entire specification designate the same constituent elements.

As exemplarily illustrated in FIGS. 2 and 3, the laundry treatment apparatus of the present invention includes a body 1 which may be separably coupled to an external support structure and configured to support clothes.

For example, the support structure may be, for example, a nail embedded in a wall, a hanger, or a supporting bar provided in a wardrobe and may be any other form so long as it can support the body 1. However, note that the support structure is not a constituent element of the laundry treatment apparatus according to the present invention.

In addition, the laundry treatment apparatus of the present invention includes a suction portion 21 provided in the body 1 to introduce outside air into the body 1 and an exhaust portion 27 provided in the body 1 to discharge inside air to the outside of the body 1.

Here, the suction portion 21 may be a hole, through which outside air is introduced into the body 1, and the exhaust portion 27 may be a hole, through which the air inside the body 1 is discharged to the outside of the body 1. The suction portion 21 and the exhaust portion 27 may have any shape of hole that can ensure the introduction and discharge of air.

Meanwhile, the laundry treatment apparatus of the present invention may include a fan 23 to introduce outside air to the body 1 through the suction portion 21 and a heater 25 to heat the air introduced through the suction portion 21.

The fan 23 is a device that is provided inside the body 1 and makes the stream of air inside and outside the body 1. Thus, when the fan 23 is driven, outside air is introduced through the suction portion 21 and inside air is discharged through the exhaust portion 27.

The heater 25 is provided inside the body 1 to generate hot air by heating the air moved by the fan 23. The heater 25 is adapted to convert electrical energy received from an external power supply or internal power supply into thermal energy to heat air using the thermal energy.

In addition, in the present invention, air circulation flow path 29 may be provided to connect the suction portion 21 and the exhaust portion 27 to each other.

The air circulation flow path 29 may be a flow path defined inside the body 1 to connect the suction portion 21 and the exhaust portion 27 to each other. That is, the suction portion 21 and the exhaust portion 27 are located at both ends of the air circulation flow path 29 such that outside air is suctioned through the suction portion 21 at one end of the air circulation flow path 29 and inside air is discharged to the outside through the exhaust portion 27 at the other end of the air circulation flow path 29. Alternatively, the air circulation flow path 29 connecting the suction portion 21 and the exhaust portion 27 to each other may be a housing integrally formed inside the body 1. That is, although the air circulation flow path 29 may be integrally formed with the body 1 during the forming of the body 1 as will be described below, in the case where the fan 23 is located in the air circulation flow path 29, one side of the air circulation flow path 29 may be provided with the exhaust portion 27 and the other side of the air circulation flow path 29 may be provided with the suction portion 21 according to the direction of rotation of the fan 23.

Meanwhile, the fan 23 and the heater 25 may be arranged respectively adjacent to the suction portion 21 or the exhaust portion 27. Alternatively, the fan 23 and the heater 25 may be provided inside the air circulation flow path 29 in terms of convenience and efficiency with regard to the design of the laundry treatment apparatus.

As described above, the air circulation flow path 29 is integrally formed simultaneously with the forming of the body 1, and a fan fixing portion (not illustrated) and a heater fixing portion (not illustrated) to which the fan and the heater may be fixed respectively are arranged inside the air circulation flow path 29, which may ensure easy assembly.

In the case where the fan 23 and the heater 25 are included inside the air circulation flow path 29 which connects the suction portion 21 and the exhaust portion 27 to each other, the arrangement sequence may be the suction portion 21, the fan 23, the heater 25, and the exhaust portion 27, or may be the suction portion 21, the heater 25, the fan 23, and the exhaust portion 27.

The air circulation flow path 29 may be connected to a plurality of suction portions 21. In this case, the suction portions 21 may be provided anywhere on the outer surface of the body 1. In contrast, only one exhaust portion 27 may be provided. This serves to allow the fan 23 and the heater 25 to intensively generate the flow of unheated cold air or heated hot air.

In other words, the air circulation flow path 29, connected to the suction portions 21, is connected to one exhaust portion 27.

In addition, the air circulation flow path 29, which connects the suction portion 21 and the exhaust portion 27 to each other, is increased in the cross sectional area thereof with decreasing distance to the exhaust portion 27. Thus, since the flow rate of the suctioned air is reduced with decreasing distance to the exhaust portion 27, the air can have sufficient time to be heated by the heater 25 when contained within the air circulation flow path 29.

Meanwhile, the fan 23 and the heater 25 are installed in a prescribed space within the air circulation flow path 29. The prescribed space is adjacent to the exhaust portion 27 and the ratio of the volume to the length of the prescribed space has a larger value than the ratio of the volume to the length of the air circulation flow path. As such, the flow rate of the air suctioned through the suction portion 21 may be rapidly reduced in the prescribed space and the air sufficiently heated by the heater 25 provided in the prescribed space may be discharged through the exhaust portion. 27

In addition, the laundry treatment apparatus of the present invention may further include a steam supply device provided inside the body 1 to outwardly supply steam.

The steam supply device may include a steam generator 31 to generate steam to be supplied to clothes, a water supplier 33 to supply water to the steam generator 31, and a steam outlet 35 to discharge the steam generated by the steam generator 31 to the outside of the body 1.

The water supplier 33 may include a flow path serving as an external water source or an inner water tank which supplies water to the steam generator 31. The water tank may be separably coupled to the body 1. In the present invention, the water supplier 33 may take the form of a water tank in order to enhance portability.

In addition, the steam generator 31 may include a storage unit (not illustrated) which receives water from the water supplier 33 and temporarily stores the water and a steam heater (not illustrated) that heats the water stored in the storage unit (not illustrated) to generate steam.

The steam outlet 35 is an aperture through which the steam generated by the steam generator 31 is discharged to the outside of the body 1. The steam discharged from the steam outlet 35 is supplied to clothes supported by the exterior of the body 1 to remove wrinkles, orders or the like from the clothes.

In addition, in the present invention, a steam discharge flow path 37 may be provided to connect the steam outlet 35 and the steam generator 31 to each other.

In this way, the steam generated in the steam generator 31 may be discharged to the steam outlet 35 through the steam discharge flow path 37 and, in turn, the steam discharged to the steam outlet 35 may be supplied to the clothes supported by the exterior of the body 1.

Meanwhile, the steam discharge flow path 37 may be connected to one side of the air circulation flow path 29. This may allow the steam supplied through the steam discharge flow path 37 to be supplied to the clothes supported by the exterior of the body 1 using the air circulation flow path 29. That is, the steam may be supplied to the outside of the body 1 using the exhaust portion 27.

In this way, through the use of the flow of air generated by the fan 23 provided in the air circulation flow path 29, the steam, hot air, cold air, or the like may be rapidly supplied to the clothes and the washing efficiency may be improved.

In addition, the laundry treatment apparatus of the present invention may further include a deodorization filter 4 provided inside the body 1 to remove odors of the clothes.

The deodorization filter 4 may be replaceable.

The deodorization filter 4 may be installed to one side of the exhaust portion 27 or the suction portion 21 to remove the odors of air introduced into or discharged from the body 1.

Alternatively, the deodorization filter 4 may be provided, along with a separate fan (not illustrated), inside a separate flow path (not illustrated) to remove the odors of air introduced into or discharged from the body 1.

However, in the present invention, the deodorization filter 4 may be provided inside the air circulation flow path 29 to remove the odors of outside air suctioned by the fan 23.

Meanwhile, the laundry treatment apparatus of the present invention may further include a fragrance supply unit 5 provided inside the body 1 to emit fragrance to the outside of the body 1.

The fragrance supply unit 5 may include a fragrant material storage unit (not illustrated) in which a fragrant material is stored and a fragrant material spraying unit (not illustrated) to spray the fragrant material. The fragrant material storage unit (not illustrated) may be replaceable.

In addition, the fragrance supply unit 5 may supply the fragrant material to the clothes supported by the exterior of the body 1 by spraying the fragrant material to the air discharged from one side of the exhaust portion 27.

Alternatively, the fragrance supply unit 5 may be provided, along with a separate fan (not illustrated), inside a separate flow path (not illustrated) to supply the fragrant material to the clothes supported by the exterior of the body 1.

However, in the present invention, the fragrance supply unit 5 may be provided inside the air circulation flow path 29.

This is because the fragrant material, sprayed to the air inside the air circulation flow path 29, may be supplied, along with hot air, to the clothes.

Meanwhile, the laundry treatment apparatus of the present invention may further include a hook 6 to allow the body 1 to be supported by the support structure.

The hook 6 may be integrally formed with the body 1 to hang the laundry treatment apparatus on the support structure (e.g., a nail or a hanger).

In addition, the laundry treatment apparatus of the present invention may further include a hook separable coupling piece 61 provided at an upper surface 11 of the body 1. In this case, the hook 6 may be separably coupled to the hook separable coupling piece 61 so as to be separated from the hook separable coupling piece 61 as needed.

Hereinafter, various embodiments of the laundry treatment apparatus according to the present invention with regard to the positions of the suction portion 21, the exhaust portion 27, and the steam outlet 35 will be described below.

As exemplarily illustrated in FIG. 2, the external appearance of the body 1 of the laundry treatment apparatus according to the present invention is defined by the upper surface 11 on which a control panel 111 is located, a lower surface 13 on which the suction portion 21 or the exhaust portion 27 may be provided, and an outer circumferential surface 15 connecting the upper surface 11 and the lower surface 13 to each other.

The outer circumferential surface 15 may include a front surface 151 provided with a screen display unit 157, a rear surface 153 opposite to the front surface 151, and a side surface 155 connecting the front surface 151 and the rear surface 153 to each other.

As exemplarily illustrated in FIGS. 3 and 4, in the laundry treatment apparatus according to the first embodiment of the present invention, either one of the exhaust portion 27 and the suction portion 21 may be perforated in the lower surface 13 of the body 1 and the other one may be provided at each of opposite ends of the perforated part.

More specifically, in the case illustrated in FIG. 3, one exhaust portion 27 is perforated in the center of the lower surface 13 of the body 1, and a pair of suction portions 21 may be provided respectively at opposite sides of the exhaust portion 27, i.e. at both ends of the lower surface 13 of the body 1.

The steam outlet 35 may be provided at one side of the suction portion 21 or the exhaust portion 27.

However, in the case where the steam outlet 35 is provided at one side of the suction portion 21, the steam discharged from the steam outlet 35 is introduced to the body 1 through the suction portion 21, causing damage such as, for example, corrosion to the fan 23 and the heater 25 provided inside the air circulation flow path 29 due to water droplets generated by condensation of water vapor or the introduced steam. Therefore, the steam outlet 35 may be provided at one side of the exhaust portion 27.

In addition, the steam outlet 35 may be located around the lower surface 13 of the body 1 provided with the exhaust portion 27 and the suction portion 21.

This corresponds to the case where the steam discharge flow path 37 and the air circulation flow path 29 are provided separately from each other, rather than being connected to each other.

As exemplarily illustrated in FIG. 5, in the laundry treatment apparatus according to a second embodiment of the present invention, any one of the exhaust portion 27 and the suction portion 21 may be perforated in the lower surface 13 of the body 1 and the other one may be perforated in the outer circumferential surface 15 of the body 1. Here, the outer circumferential surface of the body 1 means the outer side surface of the body 1.

More specifically, in FIG. 5, the exhaust portion 27 is perforated in the lower surface 13 of the body 1 and the suction portion 21 is provided at the outer circumferential surface 15 of the body 1. In addition, the steam outlet 35 may be provided at one side of the exhaust portion 27.

As exemplarily illustrated in FIG. 6, in the laundry treatment apparatus according to a third embodiment of the present invention, the suction portion 21 and the exhaust portion 27 are located at the lower surface 13 of the body 1. This is identical to that as in the first embodiment and, thus, a detailed description thereof will be omitted below.

Meanwhile, the steam outlet 35 may be perforated in the outer circumferential surface 15 of the body 1. That is, the steam outlet 35 may cause steam to be discharged through the outer side surface of the body 1. This enables steam to be supplied to the easily wrinkled shoulders and arms of the clothes.

Note that the laundry treatment apparatus according to the present invention is not limited to the above-described embodiments and the suction portion 21, the exhaust portion 27, and the steam outlet 35 may be provided anywhere on the body 1 as needed in terms of design and efficiency.

As exemplarily illustrated in FIG. 7, the operation of the laundry treatment apparatus according to the first embodiment of the present invention will be described below.

In a state in which clothes are supported by the exterior of the body 1 and the body 1 is placed on the external support structure, the laundry treatment apparatus is driven via the control panel 111 provided at the upper surface 11 of the body 1.

Thereby, the fan 23 and the heater 25 provided inside the air circulation flow path 29 are driven, thus causing outside air to be introduced to the body 1 through the suction portion 21 which is located at the lower surface 13 of the body 1. After the introduced air is heated by the heater 25, the heated air is discharged through the exhaust portion 27 to thereby be supplied to the clothes at the outside of the body 1.

In this case, the resulting hot air may be supplied to the clothes after unpleasant odors in the air are removed using the deodorization filter 4 and a fragrant material may be sprayed to the circulating air using the fragrance supply unit 5 as needed.

In addition, to remove wrinkles, odors, or the like from the clothes, the steam supply device provided inside the body 1 may be driven to supply steam to the clothes, and dry air may be supplied to dry the wet clothes in order to remove wrinkles, odors, or the like.

MODE FOR THE INVENTION

As described above, a related description has sufficiently been discussed in the above "Best Mode" for implementation of the present invention.

INDUSTRIAL APPLICABILITY

As described above, the present invention may be wholly or partially applied to a laundry treatment apparatus.

The invention claimed is:

1. A laundry treatment apparatus comprising:

a body configured to be separably coupled to a support structure provided at the outside of the laundry treatment apparatus, the body configured to support clothes;

a suction portion provided in the body, and that is configured to inhale outside air to the inside of the body;

a heater configured to heat the air introduced through the suction portion;

an exhaust portion provided in the body to discharge the air passed through the heater to the outside of the body;

an air flow path provided inside the body that is configured to connect the suction portion and the exhaust portion to each other;

a fan provided in the air flow path that is configured to introduce the outside air to the inside of the air flow path through the suction portion, and to discharge the air inside the air flow path to outside of the body through the exhaust portion; and a steam supply device provided inside the body that is configured to supply steam to the outside of the body, wherein the suction portion and the exhaust portion are provided at the lower surface of the body, and wherein air flows to the inside of the body through the suction portion and to the outside of the body through the exhaust portion based on an upper surface and a side surface of the body being closed.

2. The laundry treatment apparatus according to claim 1, wherein the steam supply device includes:

a steam generator configured to generate the steam;

a water supplier configured to supply water to the steam generator; and a steam outlet configured to discharge the steam, generated by the steam generator, to the outside of the body.

3. The laundry treatment apparatus according to claim 2, further comprising:

a steam discharge flow path configured to connect the steam generator and the steam outlet to each other.

4. The laundry treatment apparatus according to claim 3, wherein the steam discharge flow path is connected to the air flow path to supply the steam by using the air moving inside the air flow path.

5. The laundry treatment apparatus according to claim 2, wherein the steam outlet is formed at one side of the exhaust portion.

6. The laundry treatment apparatus according to claim 5, wherein any one of the suction portion and the exhaust portion is perforated in a lower surface of the body and the other one of the suction portion and the exhaust portion is provided at each of opposite ends of the lower surface of the body surrounding adjacent to the perforated part.

7. The laundry treatment apparatus according to claim 2, wherein the steam outlet is formed at one side of the suction portion.

8. The laundry treatment apparatus according to claim 1, further comprising a deodorization filter provided inside the body that is configured to remove odors from the clothes.

9. The laundry treatment apparatus according to claim 8, wherein the deodorization filter is replaceable.

10. The laundry treatment apparatus according to claim 8, wherein the deodorization filter is provided in the air flow path.

11. The laundry treatment apparatus according to claim 1, further comprising a fragrance supply unit provided inside the body that is configured to emit fragrance to the outside of the body.

12. The laundry treatment apparatus according to claim 11, wherein the fragrance supply unit is replaceable.

13. The laundry treatment apparatus according to claim 11, wherein the fragrance supply unit is provided in the air flow path.

14. The laundry treatment apparatus according to claim 1, further comprising a hook configured to support the body at the support structure.

15. The laundry treatment apparatus according to claim 14, further comprising a hook coupling member provided at the upper surface of the body that is configured to separably couple the hook to the body.

* * * * *